US006058505A

United States Patent [19]

Bettencourt

[11] Patent Number: 6,058,505

[45] Date of Patent: May 9, 2000

[54] KNEE PAD

[76] Inventor: Charles F. Bettencourt, 803 Dawn Ave., Kingfisher, Okla. 73750

[21] Appl. No.: 09/324,645

[22] Filed: Jun. 3, 1999

[51] Int. Cl.[7] ..... A41D 13/00

[52] U.S. Cl. ..... 2/24; 2/22; 2/911; 602/26

[58] Field of Search ..... 2/22, 24, 16, 455, 2/911, 919, 227; 128/881, 882; 602/23, 26; 607/108

[56] References Cited

U.S. PATENT DOCUMENTS

| | | | |
|---|---|---|---|
| 2,534,888 | 12/1950 | Vold | 2/24 |
| 4,116,236 | 9/1978 | Albert | 602/26 |
| 4,706,302 | 11/1987 | Padfield et al. | 2/22 |
| 4,964,402 | 10/1990 | Grim et al. | 602/2 |
| 5,148,804 | 9/1992 | Hill et al. | 607/108 |
| 5,301,370 | 4/1994 | Henson | 2/22 |
| 5,496,358 | 3/1996 | Rosenwald | 607/108 |
| 5,581,805 | 12/1996 | Rennick | 2/455 |
| 5,727,252 | 3/1998 | Oetting et al. | 2/24 |
| 5,924,140 | 7/1999 | Chi | 2/455 |
| 5,928,275 | 7/1999 | Yates et al. | 607/112 |

FOREIGN PATENT DOCUMENTS 84002071 6/1984 WIPO .

*Primary Examiner*—John J. Calvert
*Assistant Examiner*—Tejash Patel

[57] ABSTRACT

A knee pad for cushioning the knee region of a wearer from impact forces. The knee pad includes a pad has a generally concave interior face, a generally convex exterior face, and generally rectangular upper and lower portions. The upper portion of the pad has a width greater than that of the lower portion of the pad such that the pad has a pair of side shoulders formed between the upper and lower portions of the pad. The interior face of the pad has a pocket with a deformable pad disposed therein.

13 Claims, 2 Drawing Sheets

KNEE PAD

BACKGROUND OF THE INVENTION

1. Field of the Invention

The present invention relates to knee pads and more particularly pertains to a new knee pad for cushioning the knee region of a wearer from impact forces.

2. Description of the Prior Art

The use of knee pads is known in the prior art. More specifically, knee pads heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,706,302; U.S. Pat. No. 4,964,402; U.S. Pat. No. 3,663,973; U.S. Pat. No. 5,078,128; U.S. Pat. No. 4,055,188; and U.S. Pat. No. Des. 336,547.

While these devices fulfill their respective, particular objectives and requirements, the aforementioned patents do not disclose a new knee pad. The inventive device includes a pad has a generally concave interior face, a generally convex exterior face, and generally rectangular upper and lower portions. The upper portion of the pad has a width greater than that of the lower portion of the pad such that the pad has a pair of side shoulders formed between the upper and lower portions of the pad. The interior face of the pad has a pocket with a deformable pad disposed therein.

In these respects, the knee pad according to the present invention substantially departs from the conventional concepts and designs of the prior art, and in so doing provides an apparatus primarily developed for the purpose of cushioning the knee region of a wearer from impact forces.

SUMMARY OF THE INVENTION

In view of the foregoing disadvantages inherent in the known types of knee pads now present in the prior art, the present invention provides a new knee pad construction wherein the same can be utilized for cushioning the knee region of a wearer from impact forces.

The general purpose of the present invention, which will be described subsequently in greater detail, is to provide a new knee pad apparatus and method which has many of the advantages of the knee pads mentioned heretofore and many novel features that result in a new knee pad which is not anticipated, rendered obvious, suggested, or even implied by any of the prior art knee pads, either alone or in any combination thereof.

To attain this, the present invention generally comprises a pad has a generally concave interior face, a generally convex exterior face, and generally rectangular upper and lower portions. The upper portion of the pad has a width greater than that of the lower portion of the pad such that the pad has a pair of side shoulders formed between the upper and lower portions of the pad. The interior face of the pad has a pocket with a deformable pad disposed therein.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new knee pad apparatus and method which has many of the advantages of the knee pads mentioned heretofore and many novel features that result in a new knee pad which is not anticipated, rendered obvious, suggested, or even implied by any of the prior art knee pads, either alone or in any combination thereof.

It is another object of the present invention to provide a new knee pad which may be easily and efficiently manufactured and marketed.

It is a further object of the present invention to provide a new knee pad which is of a durable and reliable construction.

An even further object of the present invention is to provide a new knee pad which is susceptible of a low cost of manufacture with regard to both materials and labor, and which accordingly is then susceptible of low prices of sale to the consuming public, thereby making such knee pad economically available to the buying public.

Still yet another object of the present invention is to provide a new knee pad which provides in the apparatuses and methods of the prior art some of the advantages thereof, while simultaneously overcoming some of the disadvantages normally associated therewith.

Still another object of the present invention is to provide a new knee pad for cushioning the knee region of a wearer from impact forces.

Yet another object of the present invention is to provide a new knee pad which includes a pad has a generally concave interior face, a generally convex exterior face, and generally rectangular upper and lower portions. The upper portion of the pad has a width greater than that of the lower portion of the pad such that the pad has a pair of side shoulders formed between the upper and lower portions of the pad. The interior face of the pad has a pocket with a deformable pad disposed therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
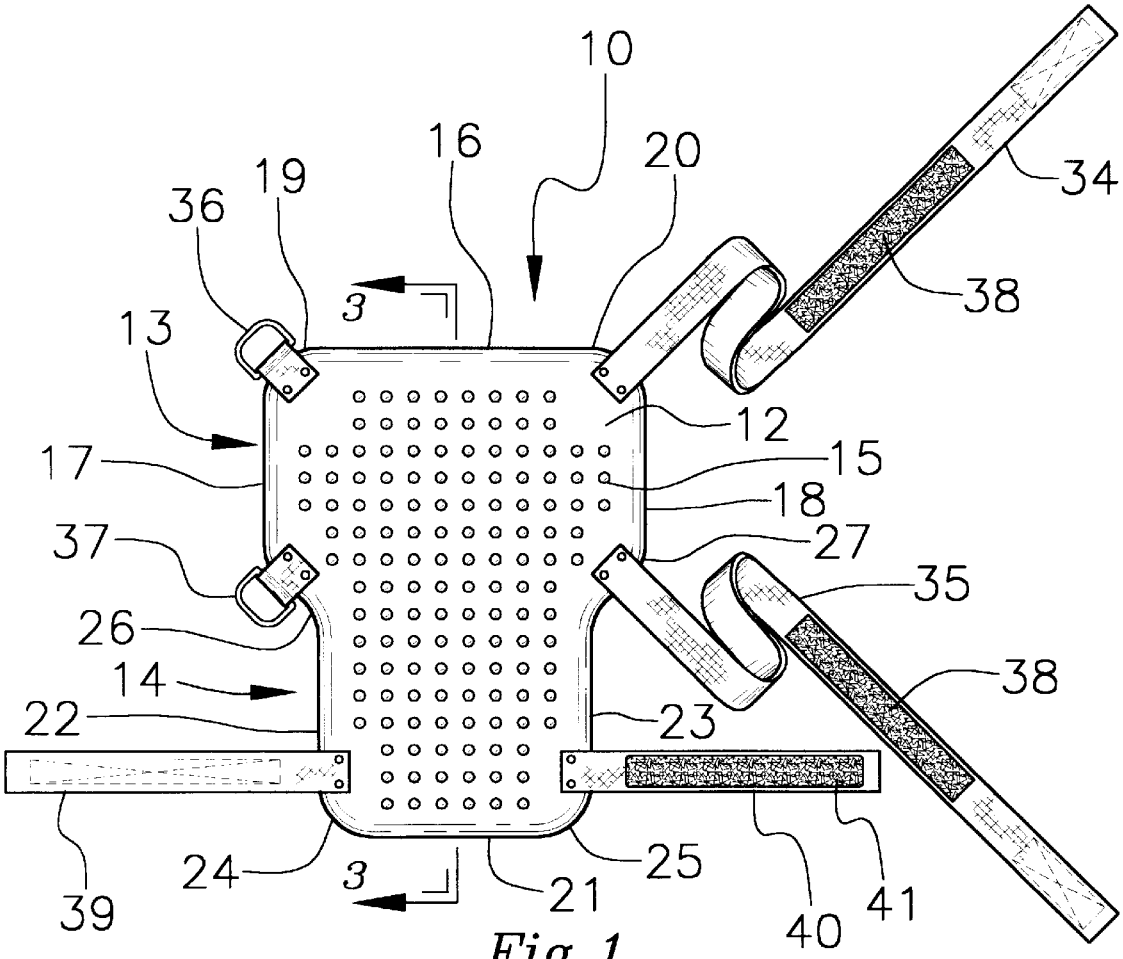
FIG. 1 is a schematic plan view of the exterior face of a new knee pad according to the present invention.
Figure 2:
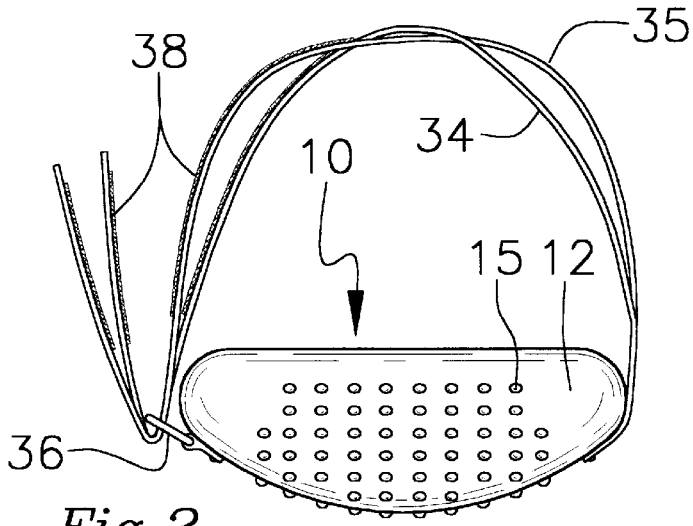
FIG. 2 is a schematic upper side view of the present invention.

With reference now to the drawings, and in particular to FIGS. 1 through 4 thereof, a new knee pad embodying the principles and concepts of the present invention will be described.

As best illustrated in FIGS. 1 through 4, the knee pad generally comprises a pad has a generally concave interior face, a generally convex exterior face, and generally rectangular upper and lower portions. The upper portion of the pad has a width greater than that of the lower portion of the pad such that the pad has a pair of side shoulders formed between the upper and lower portions of the pad. The interior face of the pad has a pocket with a deformable pad disposed therein.

The knee pad is designed for wear on a knee region of a user's leg for cushioning the impact forces on the knee region. In closer detail the knee pad comprises a pad 10 having a generally concave interior face 11, a generally convex exterior face 12, and generally rectangular upper and lower portions 13,14. In one embodiment, the pad comprises a resiliently deformable material such as a resiliently deformable hard rubber material.

In an embodiment of the present invention, the exterior face of the pad may have has a plurality of spaced apart generally hemispherical nubs 15 outwardly extending therefrom over a substantial portion of the exterior face. Preferably, as best illustrated in FIG. 1, the nubs of the exterior face of the pad may be arranged in a plurality of vertical columns and horizontal rows. Ideally, the columns of nubs are extended substantially perpendicular to the rows of nubs.

The upper portion of the pad has an outer perimeter including an upper edge 16, a pair of substantially parallel side edges 17,18 downwardly extending substantially perpendicular to the upper edge of the upper portion of the pad, and a pair of upper corners 19,20.

The lower portion of the pad has an outer perimeter including a lower edge 21, a pair of substantially parallel side edges 22,23 upwardly extending towards the upper portion substantially perpendicular to the lower edge of the lower portion of the pad, and a pair of lower corners 24,25.

The upper and lower portions of the pad each have a width defined between the side edges of the respective portion of the pad. The width of the upper portion of the pad is greater than the width of the lower portion of the pad such that the pad has a pair of side shoulders 26,27 formed between the upper and lower portions of the pad.

In one ideal embodiment, the corners of the outer perimeters of the upper and lower portions of the pad each may be rounded for preventing scratching and injury to a wear from sharp or pointed corners.

Figure 3:
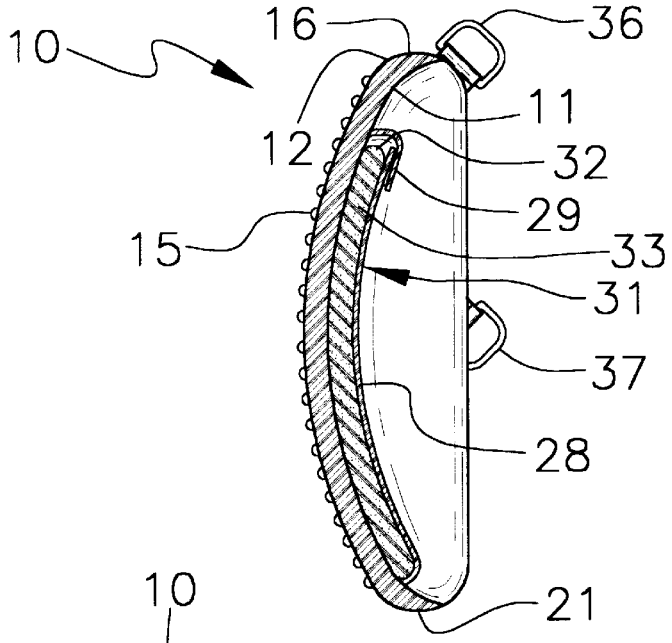
FIG. 3 is a schematic cross sectional view of the present invention taken from line 3—3 of FIG. 1.
Figure 4:
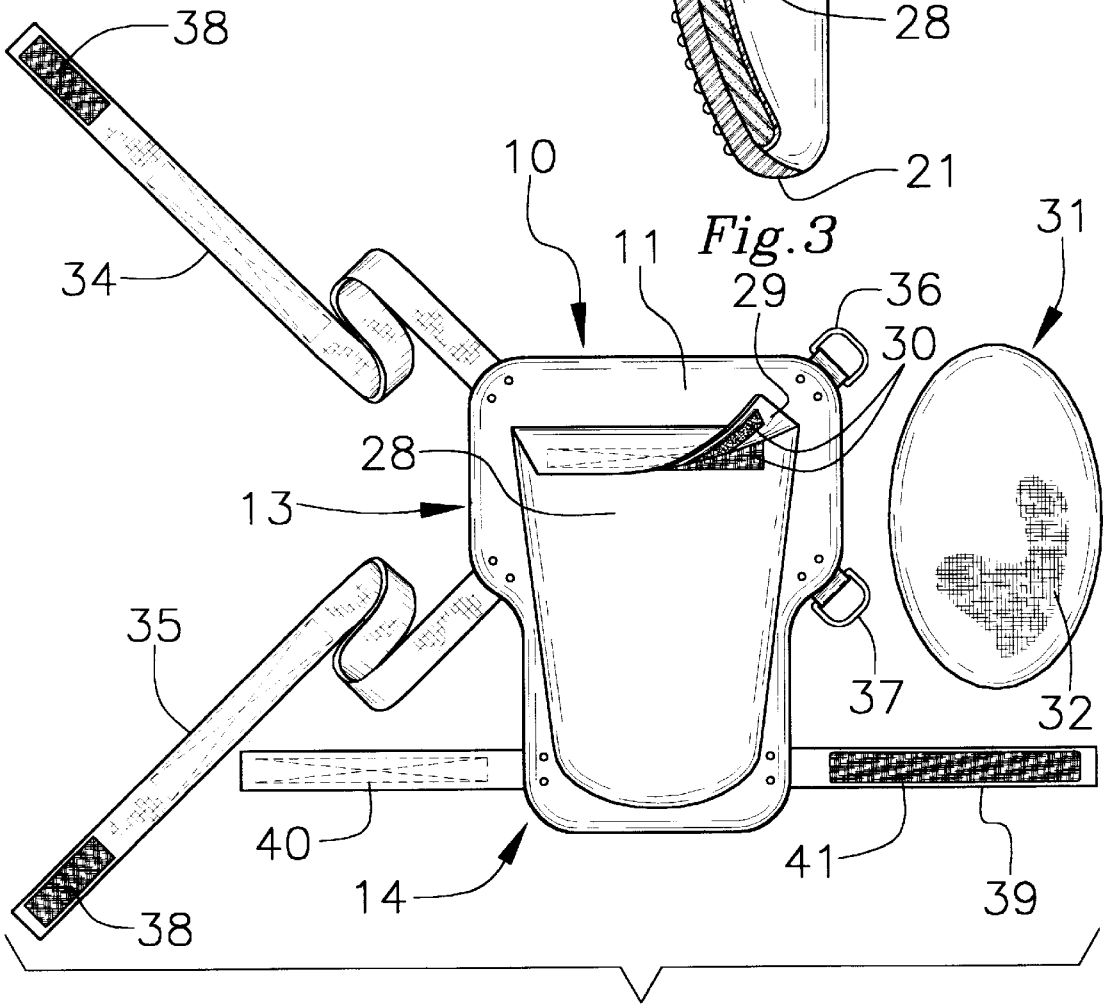
FIG. 4 is a schematic plan view of the interior face of the present invention with the deformable pad removed from inside the pocket.

With particular reference to FIGS. 3 and 4, the interior face of the pad has a pocket 28 formed by a panel coupled thereto, the pocket has portions located in the upper and lower portions of the pad such that the pocket occupies a substantial portion of the interior face of the pad. The pocket of the interior face has an upper opening therein positioned towards the upper edge of the upper portion of the pad.

In one embodiment, the pocket has a cover flap 29 coupled to the interior face of the pad and which covers the upper opening of the pocket. Preferably, the cover flap may be detachably coupled to the pocket when covering the upper opening of the pocket. Ideally, a hook and loop fastener 30 is provided for detachably coupling the cover flap to the pocket.

A deformable pad 31 for further absorbing the shock of impact forces is inserted into the pocket via the upper opening of the pocket. Preferably, the deformable pad may substantially occupy an interior space defined by the pocket. The deformable pad comprises a flexible outer packet 32 (preferably having a generally oval outer perimeter), and a gel material 33 enclosed by the outer packet. Preferably, the gel material substantially filling the outer packet.

In one preferred embodiment, elongate flexible upper and lower knee straps 34,35 are provided each having opposite first and second ends.

The first end of the upper knee strap 34 is coupled to one of the upper corners of the upper portion of the pad. The upper knee strap is outwardly extended from the outer perimeter of the upper portion of the pad preferably at an obtuse angle to both an adjacent one of the side edges of the upper portion of the pad and the upper edge of the upper portion of the pad.

The first end of the lower knee strap 35 is coupled to one of the side shoulders of the pad. Preferably, the lower knee strap is outwardly extended from the pad at an obtuse angle to both an adjacent one of the side edges of the upper portion of the pad and an adjacent one of the side edges of the lower portion of the pad.

Upper and lower securing rings 36,37 are coupled to the exterior face of the pad. The upper securing ring is positioned adjacent the other of the upper corners of the upper portion of the pad. The lower securing ring is positioned adjacent the other of the side shoulders of the pad.

The second end of the lower knee strap 35 is designed for looping through the upper securing ring 36 while the second end of the upper knee strap 34 is for looping through the lower securing ring 37 such that the knee straps crisscross behind the interior face of the pad.

The upper and lower knee straps each preferably have a hook and loop fastener 38 adjacent the second end of the respective knee strap to detachably couple the second end of the each knee strap to an adjacent portion of the respective knee strap to secure the respective knee strap in place when looped through the associated securing ring.

The knee pad may also include a pair of elongate flexible shin straps 39,40 each having opposite first and second ends.

The first end of one of the shin straps is coupled to the lower portion of the pad adjacent one of the side edges of the lower portion of the pad. Similarly, the first end of the other of the shin straps is coupled to the lower portion of the pad adjacent the other of the side edges of the lower portion of the pad.

The second ends of the shin straps are designed for detachably attaching together. Preferably, a hook and loop fastener 41 may be provided for detachably attaching the second ends of the shin straps together.

In use, the interior face of the pad is designed for receiving the knee and upper portion of the shin of a user with the knee of the user is positioned adjacent the upper portion of pad and the upper shin of the user is positioned adjacent the lower portion of the pad.

The knee straps are designed for wrapping around the back of the user's knee so that the knee straps crisscross behind the user's knee to help reduce the impedance on the bending the user's knee when wearing the knee pad. The knee straps are then looped through their associated securing loops to secure the pad on the knee of the user.

The shin straps are wrapped around the upper shin of the user and coupled together to secure the lower portion of the pad over the upper shin of the user.

Preferably, the nubs comprise a resilient material to help frictionally enhance contact between the nubs and a surface on which the exterior face of the pad rests to help prevent the pad and the knee of the user from sliding on the resting surface.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A knee pad, comprising:

a pad having a generally concave interior face, a generally convex exterior face, and generally rectangular upper and lower portions;

said upper portion of said pad having a pair of upper corners;

said lower portion of said pad having a pair of lower corners;

said upper and lower portions of said pad each having a width, said width of said upper portion of said pad being greater than said width of said lower portion of said pad such that said pad has a pair of side shoulders formed between said upper and lower portions of said pad;

said interior face of said pad having a pocket;

a deformable pad being disposed in said pocket;

elongate flexible upper and lower knee straps each having opposite first and second ends, wherein said first end of said upper knee strap is coupled to one of said upper corners of said upper portion of said pad, and wherein said first end of said lower knee strap is coupled to one of said side shoulders of said pad; and upper and lower securing rings being coupled to said pad, said upper securing ring being positioned adjacent the other of said upper corners of said upper portion of said pad, said lower securing ring being positioned adjacent the other of said side shoulders of said pad, wherein said second end of said lower knee strap is for looping through said upper securing ring and said second end of said upper knee strap is for looping through said lower securing ring.

2. The knee pad of claim 1, wherein said exterior face of said pad has a plurality of spaced apart resilient nubs outwardly extending therefrom.

3. The knee pad of claim 2, wherein said nubs of said exterior face of said pad are arranged in a plurality of columns and rows.

4. The knee pad of claim 1, wherein said pocket of said interior face has an upper opening therein positioned towards an upper edge of said upper portion of said pad, wherein said pocket having a cover flap coupled to said interior face of said pad and covering said upper opening of said pocket.

5. The knee pad of claim 4, wherein said cover flap is detachably coupled to said pocket when covering said upper opening of said pocket.

6. The knee pad of claim 1, wherein said deformable pad comprises a flexible outer packet and a gel material enclosed by said outer packet.

7. The knee pad of claim 1, further comprising a pair of elongate flexible shin straps each having opposite first and second ends, wherein said first end of one of said shin straps is coupled to said lower portion of said pad adjacent one of said lower corners of said lower portion of said pad, wherein said first end of the other of said shin straps is coupled to said lower portion of said pad adjacent the other of said lower corner of said lower portion of said pad, and wherein said second ends of said shin straps are for detachably attaching together.

8. A knee pad, comprising:

a pad having a generally concave interior face, a generally convex exterior face, and generally rectangular upper and lower portions;

said exterior face of said pad having a plurality of spaced apart generally hemispherical nubs outwardly extending therefrom;

said nubs of said exterior face of said pad being arranged in a plurality of columns and rows;

said upper portion of said pad having an outer perimeter including an upper edge, a pair of substantially parallel side edges downwardly extending substantially perpendicular to said upper edge of said upper portion of said pad, and a pair of upper corners;

said lower portion of said pad having an outer perimeter including a lower edge, a pair of substantially parallel side edges upwardly extending towards said upper portion substantially perpendicular to said lower edge of said lower portion of said pad, and a pair of lower corners;

said upper and lower portions of said pad each having a width defined between said side edges of the respective portion of said pad;

said width of said upper portion of said pad being greater than said width of said lower portion of said pad such that said pad has a pair of side shoulders formed between said upper and lower portions of said pad;

said interior face of said pad having a pocket, said pocket having portions located in said upper and lower portions of said pad;

said pocket of said interior face having an upper opening therein positioned towards said upper edge of said upper portion of said pad;

said pocket having a cover flap coupled to said interior face of said pad and covering said upper opening of said pocket;

said cover flap being detachably coupled to said pocket when covering said upper opening of said pocket, wherein a hook and loop fastener is provided for detachably coupling said cover flap to said pocket;

a deformable pad being inserted into said pocket via said upper opening of said pocket;

said deformable pad comprising a flexible outer packet having a generally oval outer perimeter, and a gel material enclosed by said outer packet;

elongate flexible upper and lower knee straps each having opposite first and second ends;

said first end of said upper knee strap being coupled to one of said upper corners of said upper portion of said pad;

said first end of said lower knee strap being coupled to one of said side shoulders of said pad;

upper and lower securing rings being coupled to said exterior face of said pad, said upper securing ring being positioned adjacent the other of said upper corners of said upper portion of said pad, said lower securing ring being positioned adjacent the other of said side shoulders of said pad;

said second end of said lower knee strap being for looping through said upper securing ring and said second end of said upper knee strap being for looping through said lower securing ring;

said upper and lower knee straps each having a hook and loop fastener adjacent said second end of the respective knee strap to detachably couple said second end of the each knee strap to an adjacent portion of the respective knee strap to secure the respective knee strap in place when looped through the associated securing ring;

a pair of elongate flexible shin straps each having opposite first and second ends;

said first end of one of said shin straps being coupled to said lower portion of said pad adjacent one of said side edges of said lower portion of said pad, said first end of the other of said shin straps being coupled to said lower portion of said pad adjacent the other of said side edges of said lower portion of said pad; and said second ends of said shin straps being for detachably attaching together, wherein a hook and loop fastener is provided for detachably attaching said second ends of said shin straps together.

9. A knee pad, comprising:

a pad having a generally concave interior face, a generally convex exterior face;

said exterior face of said pad having a plurality of spaced apart generally hemispherical nubs outwardly extending therefrom;

said upper portion of said pad having an outer perimeter including an upper edge, a pair of substantially parallel side edges;

said lower portion of said pad having an outer perimeter including a lower edge, a pair of substantially parallel side edges;

said upper and lower portions of said pad each having a width defined between said side edges of the respective portion of said pad;

said width of said upper portion of said pad being greater than said width of said lower portion of said;

said interior face of said pad having a pocket;

said pocket of said interior face having an upper opening;

said pocket having a cover flap coupled to said interior face of said pad and covering said upper opening of said pocket;

said cover flap being detachably coupled to said pocket when covering said upper opening of said pocket;

a deformable pad being inserted into said pocket;

elongate flexible upper and lower knee straps;

said first end of said upper knee strap being coupled said pad;

said first end of said lower knee strap being coupled said pad;

upper and lower securing rings being coupled to said exterior face of said pad;

said second end of said lower knee strap being for looping through said upper securing ring and said second end of said upper knee strap being for looping through said lower securing ring; and said upper and lower knee straps each having a hook and loop fastener adjacent said second end of the respective knee strap to detachably couple said second end of the each knee strap to an adjacent portion of the respective knee strap to secure the respective knee strap in place when looped through the associated securing ring.

10. The knee pad of claim 9, wherein said deformable pad comprising a flexible outer packet having a generally oval outer perimeter, and a gel material enclosed by said outer packet.

11. The knee pad of claim 9, wherein said upper securing ring being positioned adjacent the other of said upper corners of said upper portion of said pad, said lower securing ring being positioned adjacent the other of said side shoulders of said pad.

12. The knee pad of claim 9, further comprises a pair of elongate flexible shin straps each having opposite first and second ends, said first end of one of said shin straps being coupled to said lower portion of said pad adjacent one of said side edges of said lower portion of said pad, said first end of the other of said shin straps being coupled to said lower portion of said pad adjacent the other of said side edges of said lower portion of said pad, said second ends of said shin straps being for detachably attaching together, wherein a hook and loop fastener is provided for detachably attaching said second ends of said shin straps together.

13. The knee pad of claim 9, wherein a hook and loop fastener is provided for detachably coupling said cover flap to said pocket.

* * * * *